United States Patent [19]

Zucker et al.

[11] Patent Number: 4,976,360

[45] Date of Patent: Dec. 11, 1990

[54] MERCHANDISE DISPLAY STAND

[75] Inventors: Armand S. Zucker, Skokie; David S. Breslow, Chicago; Harald Giebel, Westchester, all of Ill.

[73] Assignee: RTC Industries, Inc., Chicago, Ill.

[21] Appl. No.: 464,374

[22] Filed: Jan. 12, 1990

[51] Int. Cl.[5] ..... A47F 5/00

[52] U.S. Cl. ..... 211/186; 108/111; 211/188

[58] Field of Search ..... 211/133, 186, 194, 188, 211/187; 108/111

[56] References Cited

U.S. PATENT DOCUMENTS

| | | | |
|---|---|---|---|
| 3,851,601 | 12/1974 | Davis | 108/111 X |
| 4,010,698 | 3/1977 | Taub | 108/111 |
| 4,145,977 | 3/1979 | Yellin | 108/111 |
| 4,467,927 | 8/1984 | Nathan | 211/186 X |
| 4,501,369 | 2/1985 | Fox | 211/187 X |
| 4,628,625 | 12/1986 | Hepp | 211/133 X |
| 4,901,872 | 2/1990 | Lang | 211/133 |

*Primary Examiner*—Robert W. Gibson, Jr.

*Attorney, Agent, or Firm*—Dressler, Goldsmith, Shore, Sutker & Milnamow, Ltd.

[57] ABSTRACT

A display stand assembly in which the main shelves have side rims provided with rectangular collars at opposite ends thereof. Vertical side members comprising top and bottom cross beams having channel-shaped top receivers and channel-shaped bottom inserts cooperate with the main shelves. The top receivers fit frictionally and snugly into the collars of a shelf rim thereabove and bottom inserts fit snugly into the receivers of a side member therebelow, whereby a pair of side members cooperate with the collar of the shelf to provide three-wall support for the shelf therebetween. The bottom cross beams cooperate with longitudinal recesses in the shelf rim to further stabilize the assembly. Extension end shelves are provided which are frictionally attachable to the main shelf side rims for increased merchandise support area. There are floor support feet which have a similar channel-shaped receiver insertable into a collar of the bottommost shelf of the assembly.

15 Claims, 4 Drawing Sheets

46
44
46
42
36
46
44
46
40
35
40
42
40
48
50
52
18
28
38
27
16
48
30
26
50
52
32
21
28
26
61
62
58
55
56

40
38
21
16
27
28
36
40

58a

MERCHANDISE DISPLAY STAND

TECHNICAL FIELD

This invention relates to free standing display racks or stands and, more particularly, to a form of construction and interrelationship of basic elements that permits ready assembly and disassembly without the use of tools or connectors.

BACKGROUND OF THE INVENTION

Modern merchandising practices rely ever more heavily on unattended merchandise displays and customer self service. Such practices demand efficient use of floor and aisle space which are typically at a premium. Merchandise displays must be attractively and strategically placed and must be readily adaptable for changes in positioning and merchandise capacity. Since the typical clerk in a food market or general department store may be unskilled in the use of tools and erection of support structures, display stands which require tools and connectors for complex assembly or disassembly operations are of limited value and application. Similarly, the need for frequent display changes and fresh designs and motifs militates against display stands that are expensive and substantially permanent in nature.

There thus exists a need for a display stand structure that is simple to assemble and disassemble and requires no tools or connectors for those operations. The display stand should be relatively inexpensive and yet be stable and easily adaptable for varying capacities of merchandise display.

SUMMARY OF THE INVENTION

The present invention provides a merchandise display stand which may be quickly and readily assembled without the use of tools or separate connectors. The invention comprises a minimum number of universal elements that can be connected in modular fashion to vary the size and capacity of the assembled stand.

In general, the display stand of the invention comprises four universal structural elements. There is a central shelf element having structural support openings or collars formed adjacent the corners thereof. A side upright member is adapted to cooperate with the shelf element to erect the stand. Each upright member is formed with a pair of cross beams which carry a pair of upper legs and a pair of lower legs. The upper legs are of a greater dimension than the lower legs and provide receiver structures adapted to snugly receive therein the lower legs, or insert structures, of a second post member mounted thereabove. The upper legs, on the other hand, are adapted to be snugly received in the collars formed in the shelf element. The shelf element and upright member provide the basic structural members permitting modular vertical erection of the stand; and the lower cross beam of the upright member cooperates with a side rim of the shelf element to further stabilize the assembled structure.

The invention comprises further a vertical foot member for supporting the stand on a floor, said foot member comprising, in effect, an upper portion of an upright member. Thus, each foot member has an upper leg that is received through the collars in the bottommost shelf and which, in turn, receives therein a lower leg of the bottommost upright. A bottom leg insert comprising an upper leg alone may be substituted for the foot member when it is desired to support the stand with its bottommost shelf in direct contact with an existing supporting surface such as a gondola shelf.

The fourth structural element comprises a relatively smaller end shelf adapted to be frictionally attached to one or both ends of the central shelf for increasing the area and merchandise capacity of the shelf.

The shelf assembly also comprises a fascia member adapted to cosmetically finish the ends of the shelf elements and a top member or roof adapted to decoratively finish the assembled stand. All of the elements of the stand, both structural and decorative, may be readily assembled and disassembled in a matter of minutes without the use of connectors or tools.

Numerous other features and advantages of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts through the same.

DETAILED DESCRIPTION OF THE INVENTION

Figure 1:
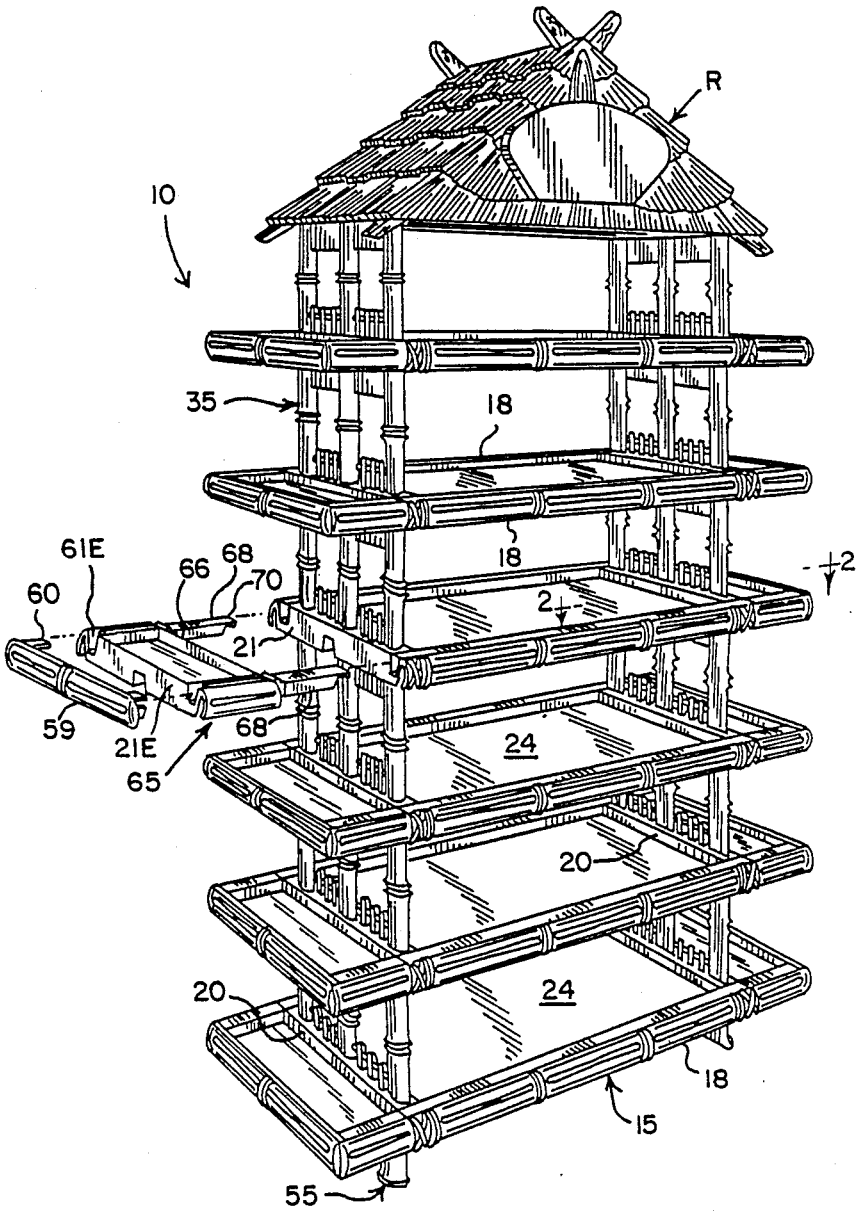
FIG. 1 is a perspective view of an assembled merchandise display stand embodying the principles of the invention, with an end shelf being exploded away to illustrate the central shelf element alone.

Referring with greater particularity to the various Figures of the drawings, it will be seen that the display stand 10 comprises generally a central shelf element 15, a vertical upright member 35, a foot element 55, and an end shelf element 65. In the embodiment illustrated, the shelf members and upright elements are styled to simulate bamboo and the overall motif of the stand designed to appear tropical, being topped with a simulated thatched roof R; but other motifs could as well be employed as will become apparent from the following description.

Shelf 15 comprises a planar tray or well 16 bounded by upraised front and rear rims 18,18, and upraised lateral or side rims 20,20. The outside walls of the rims 18 may be plain or may include a decorative effect such as the bamboo pattern illustrated, while rim 20 preferably comprises a planar outer wall 21 for reasons to be described. In the preferred embodiment illustrated, the shelf 15, as well as all other parts, is molded of suitable plastics. Thus, the tray 16 is formed with a plurality of cutouts 22 for conservation of material and reduction of weight, although the same could also be solid throughout. Merchandise may be supported directly on the tray 16 or, as illustrated in FIG. 1, a complementary plate or sheet 24 may be used to cover the tray.

Figure 2:
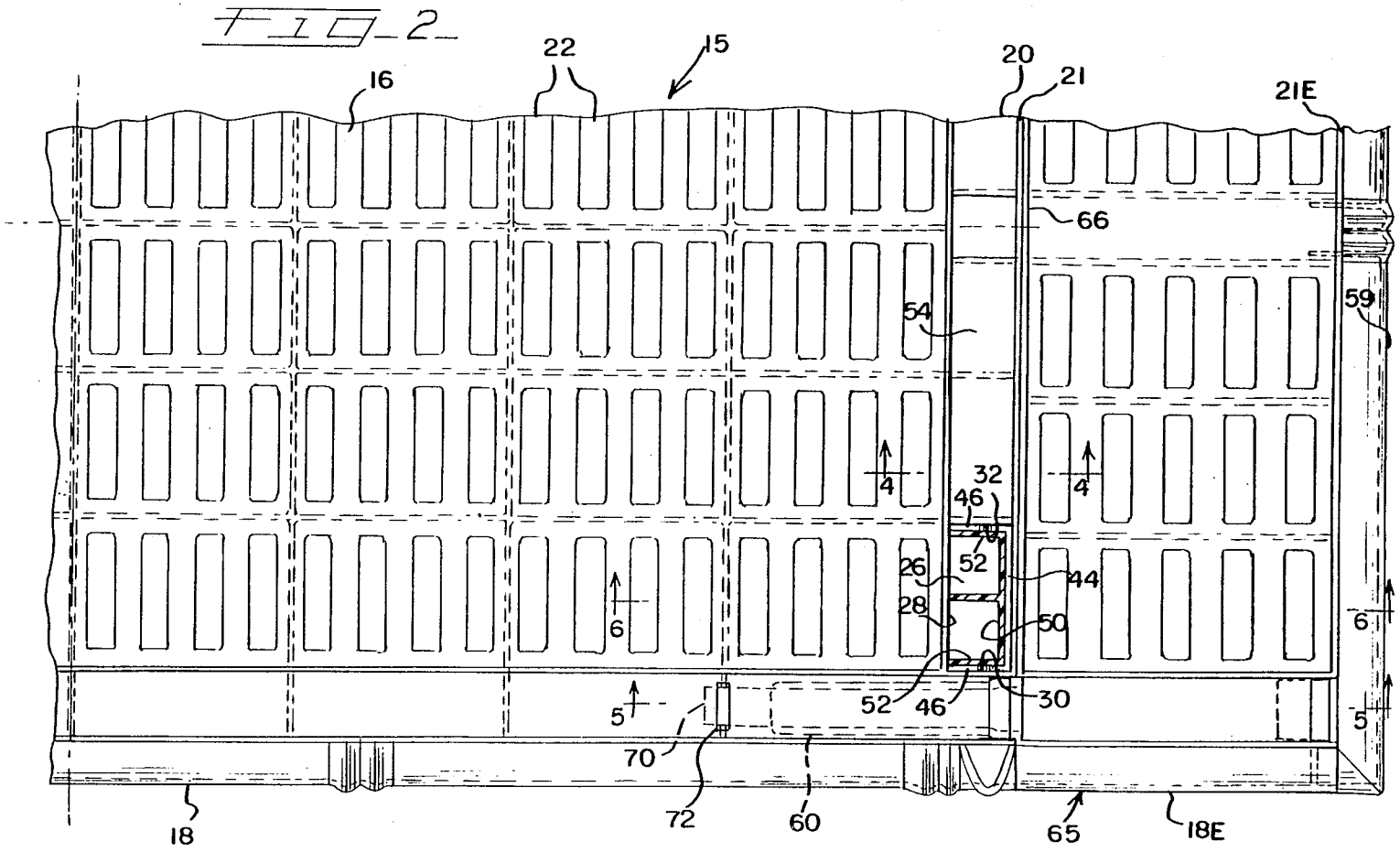
FIG. 2 is a fragmentary horizontal sectional view substantially on the plane of line 2—2 of FIG. 1.
Figures 3, 3A, 4:
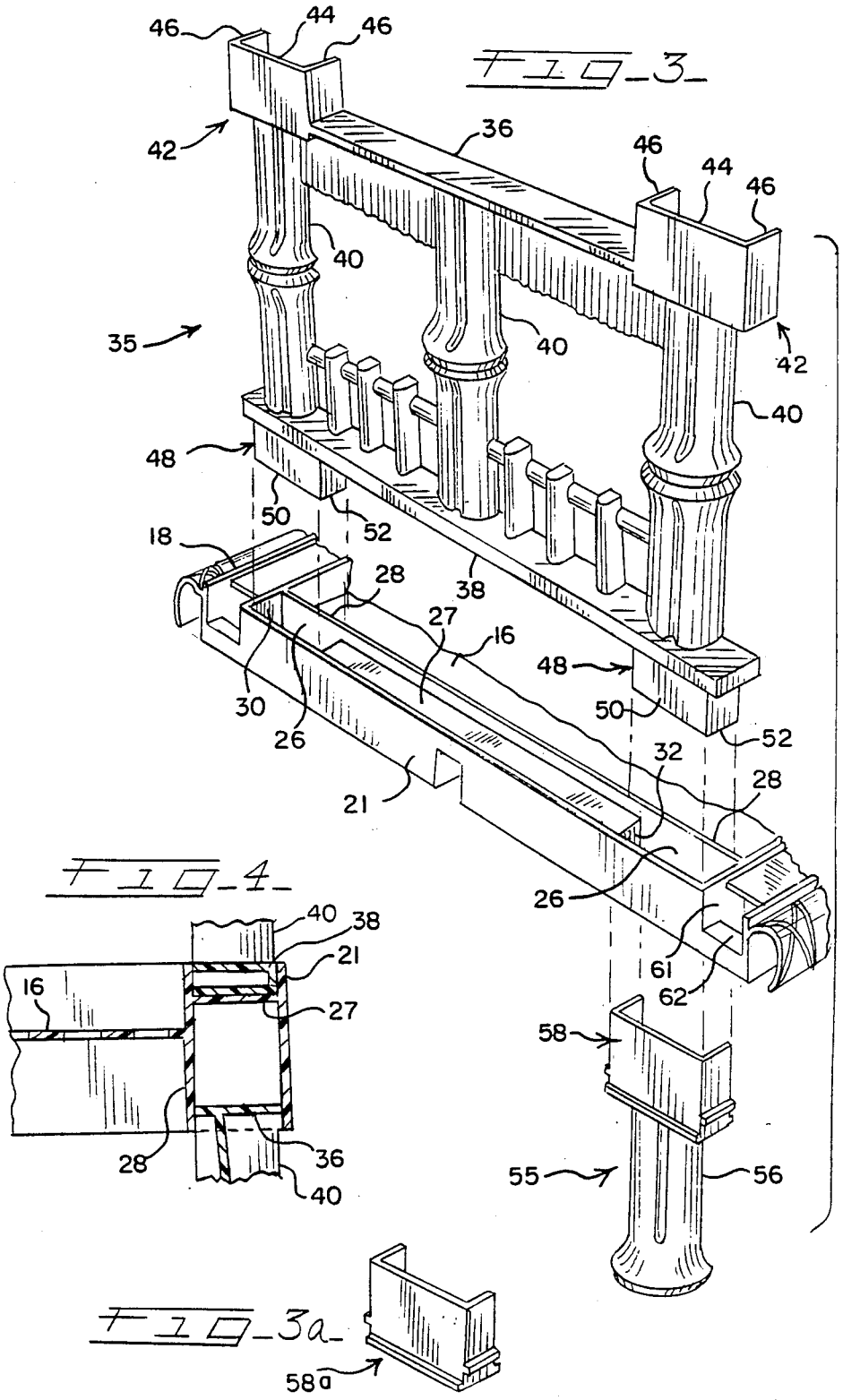
FIG. 3 is an exploded perspective view showing an upright member, a bottommost central shelf element, and a foot member, and the relationship therebetween.
FIG. 3*a* is a perspective view of an alternative bottom support member.
FIG. 4 is a sectional view on the plane of line 4—4 in FIG. 2.
Figure 6:
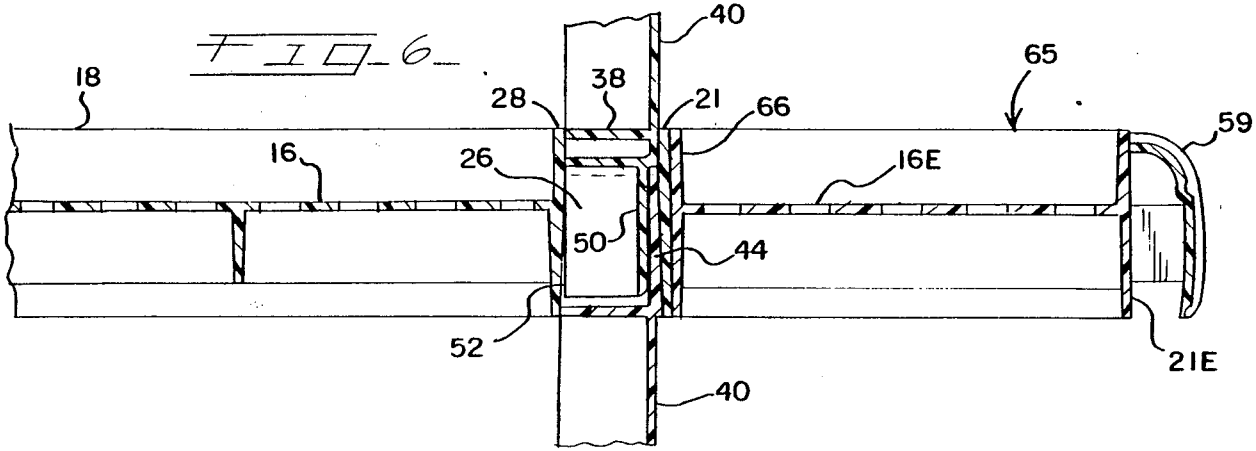
FIG. 6 is a sectional view on the plane of line 6—6 in FIG. 2.

Turning to FIGS. 2, 3, and 6, it will be seen that the side rim 20 comprises a rectangular hole or collar 26 adjacent each end thereof and a top wall 27 therebetween. Each of the collars 26 is defined by an inner wall 28, a pair of end walls 30 and 32, and the rim outer wall 21. The shelf 15 thus is provided with four collars 26 located substantially at the corners thereof. It should be noted that the top wall 27 and end walls 30 and 32 are positioned below the upper edges of the rim 20 and thereby provide a longitudinal well or recess for reasons which will become apparent as the description proceeds.

For operationally assembling the shelves 15 in vertically spaced relationship to form the stand 10, the invention comprises a plurality of upright members 35. As seen in FIG. 3, the upright member 35 comprises an upper cross beam 36 and a lower cross beam 38 interconnected by columns such as 40,40,40. A receiver channel 42 is integrally formed at each end of the upper cross beam 36 and projects thereabove, said channel comprising an outer wall 44 and a pair of inwardly projecting legs 46,46. Depending from the lower cross beam 38 adjacent the opposite ends thereof is an integrally formed insert channel 48, said channel comprising an outer wall 50 and a pair of inwardly directed legs 52,52. Receiver channel 42 is of slightly larger dimension than insert channel 48 and is thereby adapted to snugly receive therein the insert channel 48 of an upright member 35 positioned thereabove and in vertical registry therewith. Receiver channel 42 is also dimensioned to be snugly received within a rectangular shelf collar 26. The lower cross beam 38 is dimensioned to be snugly received in the longitudinal recess in the side rim 20.

Assembly of the shelves 15 and upright members 35 to form the stand 10 may now be appreciated with particular reference to FIGS. 2, 3, and 6. The receiver channels 42 of a pair of upright members 35 are inserted into the four corner collars 26 of a shelf 15 thereabove. The insert channels 48 of a second pair of upright members 35 are then inserted into the four receiver channels 42 therebeneath. In this assembled relationship, it will be noted that there is reinforcing cooperation between the triple thickness of the respective walls 50,44,21, and legs 52,46, and end walls 30 and 32, to provide a strong and secure assembly. Additionally, the lower cross beams 38 of the upper pair of upright members 35 cooperate with the longitudinal shelf recesses and the top cross beams of the lower pair of upright members abut the bottoms of the shelf rims thereabove to further stabilize the entire structure. The roof R is provided with suitable openings (not shown) for positioning and retention on the topmost pair of upright members 35 of the assembled stand.

Feet 55 are provided for supporting the assembled display stand 10 above a floor. The foot 55 comprises a post 56 having integrally formed at the top thereof a receiver channel 58 similar in dimension and configuration to the receiver channels 42 of the upright members 35. It will thus be appreciated that the receiver channels 58 of four feet 55 are insertable into the collars 26 of the bottommost shelf 15 for similarly secure support of the entire stand.

As an alternative to positioning on the floor, it is sometimes desired to support the display stand on an existing shelf or gondola with the bottommost display shelf in direct contact with the gondola shelf. For this purpose, the invention comprises receiver channels 58*a* (see FIG. 3*a*) which are in all respects similar to the channels 58, but without the posts 56 of the feet 55. Insertion of the channels 58*a* into the collars of the bottommost shelf 15 enables said shelf to rest directly on the gondola shelf.

Figure 5:
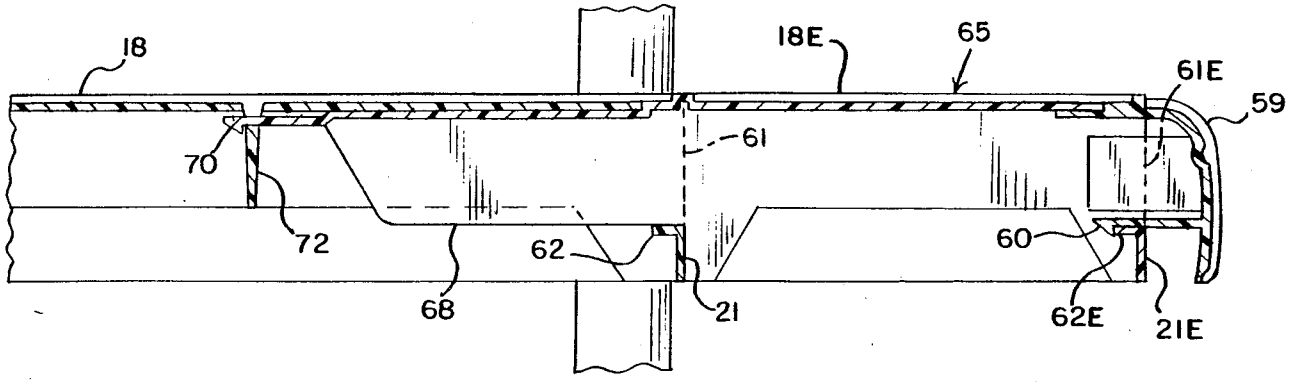
FIG. 5 is a sectional view on the plane of line 5—5 of FIG. 2.

Operational assembly of the three structural elements as thus far described provides a basic display stand which may be utilized in that condition if desired. In such case, the invention comprises a fascia element 59 having flexible finger means 60 whereby the same is releasably connectable to the shelf outer wall 21 through openings 61 and inner retention ledges 62 formed in rims 18 of the shelf 15 (see FIGS. 1, 3, and 5).

When increased capacity of the stand 10 is desired, the invention comprises detachable extension or end shelves 65 connectable to the sides of the main or central shelf 15. End shelf 65 is complementary in form and appearance to the shelf 15 and thus comprises a tray 16E, front and rear rims 18E,18E, a planar inner wall 66, and a planar outer wall 21E. Outer wall 21E comprises openings 61E and retention ledges 62E formed in the rims 18E whereby the fascia element 59 may be releasably connected thereto in the same manner as already described. A pair of elongated attachment members 68 project integrally from the inner wall 66 and said attachment members carry resilient frictional means 70 at the inner ends thereof. The frictional means 70 are snap-engageable with apertured walls 72 formed in the rims 18 of the shelf 15. To releasably attach an end shelf 65 to a shelf 15 it is simply necessary to insert the attachment members through the openings 61 and press inwardly until the frictional means 70 snap-engage the walls 72 at which time the inner wall 66 is also in secure abutting relationship with the shelf wall 21.

It should be appreciated that a preferred embodiment of the invention has been described herein for illustrative purposes only and is not otherwise limiting of the structural concepts of the invention. Thus, for example, the number of columns 40 in the upright element may be varied or eliminated by substitution of other structures between the upper and lower cross beams of the upright elements. Similarly, the contours and design appearance of the upright elements, shelves and legs may be varied in numerous ways. Other changes and variations may be made by those skilled in the art without departing from the spirit and scope of the invention as defined in the appended claims.

What is claimed is:

1. A display stand assembly comprising:

a plurality of main shelves, each of said main shelves comprising:

a lateral rim at opposite sides thereof, and a tubular collar through said rim adjacent opposite ends thereof; and a plurality of side upright members, each of said upright members comprising:

an upper cross beam and a lower cross beam, a pair of open-top legs projecting upwardly from said upper cross beam adjacent opposite ends thereof, and a pair of open-bottom legs depending from said lower cross beam adjacent opposite ends thereof, said open-top legs being receivable in contour-accommodating relationship in the rim collars of a shelf positioned thereabove, and said open-bottom legs being receivable in contour-accommodating relationship in the open-top legs of an upright member positioned therebeneath, whereby pairs of upright members positioned above and beneath a shelf operationally support said shelf therebetween.

2. A display stand assembly according to claim 1 comprising a longitudinal recess in said lateral rim, said lower cross beam mating with a recess positioned therebeneath for stabilizing the operationally assembled display stand.

3. A display stand according to claim 2 wherein the upper cross beams of said upright members abut the bottoms of the lateral rims positioned thereabove in the operationally assembled display stand.

4. A display stand assembly according to claim 1 wherein said collar comprises four walls defining a rectangular opening, said open-top leg comprising a receiver channel and said open-bottom leg comprising an insert channel, said channels being of complementary configuration with said rectangular opening, whereby an operationally assembled shelf and a pair of upright members comprise a cooperating three-wall thickness of said collar and channel legs.

5. A display stand assembly according to claim 4 comprising a plurality of feet for supporting the assembled stand in free standing relationship, each of said feet comprising a post and an integral receiver channel receivable in contour-accommodating relationship in the collar of the bottommost shelf of the assembled display stand.

6. A display stand assembly according to claim 4 comprising a plurality of receiver channels receivable in contour-accommodating relationship in the collars of the bottommost shelf of the assembled display stand for supporting said bottommost shelf in substantially direct contact with a supporting surface.

7. A display stand assembly according to claim 1 comprising a plurality of end shelves, and cooperating connector means on said end shelves and main shelves for frictionally attaching an end shelf to the lateral rim of a main shelf in abutting relationship with said lateral rim.

8. A display stand assembly according to claim 7 comprising a fascia member, said end shelf comprising a side rim of the same configuration as said lateral rim, and cooperating connector means on said fascia member and said main and end shelves for frictionally and selectively attaching said fascia member to said main shelf or end shelf in abutting relationship with said rims.

9. A display stand assembly comprising:

a plurality of rectangular main shelves, each of said main shelves having opposed side rims;

a rectangular collar defined by four walls formed in said each side rim adjacent opposite ends thereof;

a plurality of side upright members, each of said upright members comprising an upper cross beam, a lower cross beam and vertical means interconnecting said cross beams;

a pair of open-top channel-shaped receivers projecting integrally from said upper cross beam adjacent the opposite ends thereof; and a pair of open-bottom channel-shaped inserts depending integrally from said lower cross beam adjacent the opposite ends thereof, said receivers being receivable in contour-accommodating relationship in the collars of a shelf positioned thereabove and said inserts being receivable in contour-accommodating relationship in the receivers of an upright member positioned therebeneath, whereby three thicknesses of said collars and channel legs cooperate to operationally retain a main shelf between pairs of upright members.

10. A display stand assembly according to claim 9 comprising a longitudinal recess in each of said side rims, said lower cross beams being snugly receivable in their associated recesses to stabilize the operationally assembled main shelves and upright members.

11. A display stand assembly according to claim 9 wherein said upper cross beams abut against the bottoms of their associated main shelf side rims to stabilize the operationally assembled main shelves and upright members.

12. A display stand assembly according to claim 9 comprising a plurality of floor-support feet, each of said feet comprising a post and an integral channel-shaped receiver insertable in contour-accommodating relationship into a collar of the bottommost shelf of the operationally assembled stand and adapted to receive in contour-accommodating relationship the insert of the bottommost upright member.

13. A display stand assembly according to claim 9 comprising a plurality of receiver channels, each of said channels being insertable in contour-accommodating relationship into a collar of the bottommost shelf of the operationally assembled stand and adapted to receive in contour-accommodating relationship the insert of the bottommost upright member whereby said bottommost shelf is supportable in substantially direct contact with a supporting surface.

14. A display stand assembly according to claim 9 comprising a plurality of rectangular end shelves of complementary configuration with said main shelves, each of said end shelves having inwardly projecting connectors, and means on said main shelves for snap-engagement with said connectors for releasable attachment of said end shelf to the side rim of a main shelf.

15. A display stand assembly according to claim 14 wherein the side rims of said main and end shelves comprises similar planar outer surfaces, and comprising a fascia member, snap-engaging fingers on said fascia member, and cooperating engagement means on said main and end shelves, whereby said fascia member is selectively attachable to the side rim of either of said end and main shelves.

* * * * *